US007766597B2

(12) United States Patent
Tanaka et al.

(10) Patent No.: US 7,766,597 B2
(45) Date of Patent: Aug. 3, 2010

(54) LOADER WORK MACHINE

(75) Inventors: Tomiho Tanaka, Tondabayashi (JP); Arinobu Ishida, Sakai (JP); Kosuke Oyama, Sakai (JP); Ryoichi Nishi, Kawachinagano (JP); Shusaku Yamaguchi, Sennan (JP); Naoya Tsuda, Fujiidera (JP); Masataka Takagi, Sakai (JP)

(73) Assignee: Kubota Corporation, Osaka (JP)

( * ) Notice: Subject to any disclaimer, the term of this patent is extended or adjusted under 35 U.S.C. 154(b) by 207 days.

(21) Appl. No.: 11/375,371

(22) Filed: Mar. 14, 2006

(65) Prior Publication Data

US 2007/0003401 A1 Jan. 4, 2007

(30) Foreign Application Priority Data

Jun. 30, 2005 (JP) ..... 2005-192535

(51) Int. Cl.
*E02F 9/00* (2006.01)

(52) U.S. Cl. ..... 414/686; 280/783

(58) Field of Classification Search ..... 414/686; 280/783; 417/540

See application file for complete search history.

(56) References Cited

U.S. PATENT DOCUMENTS

| | | | | |
|---|---|---|---|---|
| 5,248,237 | A * | 9/1993 | Nakamura | 414/686 |
| 6,866,066 | B2 * | 3/2005 | Weber | 138/31 |
| 2004/0150209 | A1 * | 8/2004 | Valdez et al. | 280/781 |

FOREIGN PATENT DOCUMENTS

JP 56-171868 12/1981

* cited by examiner

*Primary Examiner*—Donald Underwood
(74) *Attorney, Agent, or Firm*—The Webb Law Firm

(57) ABSTRACT

The invention provides a loader work machine with improved front visibility and improved aesthetic appearance. The loader work machine includes a self-propelled machine body, a work device having a boom, a boom cylinder, and a side frame for vertically pivotally supporting base portions of the boom and the boom cylinder, and a frame unit for attaching the work device to the self-propelled machine body. The frame unit has a support platform projecting laterally outward from the self-propelled machine body and a main frame mounted erect on the support platform for supporting and connecting a lower portion of the side frame. An accumulator is connected to the boom cylinder for absorbing shock occurring during a vertical pivotal movement of the work device and this accumulator is attached to the frame unit.

6 Claims, 6 Drawing Sheets

LOADER WORK MACHINE

BACKGROUND OF THE INVENTION

1. Field of the Invention

The present invention relates to a loader work machine. The term "loader work machine" as used herein refers generically to a group of loading/unloading vehicles for use in agricultural works, civil engineering works, etc. some non-limiting examples of which include a tractor mount type loader formed by mounting a front loader and/or a backhoe to a tractor, a self-propelled loader (wheeled loader, self-propelled backhoe, a power shovel, etc.)

2. Description of the Related Art

There is known a loader work machine in which an accumulator for absorbing shock occurring during a vertical pivotal movement of a work device (e.g. a front loader) connected to a self-propelled vehicle body is connected to a hydraulic circuit (see e.g. Japanese Utility Model Application "Kokai" No. 56-171868). This accumulator is disposed adjacent a boom cylinder forwardly, rearwardly or upwardly, etc. of a connecting pipe interconnecting right and left boom members.

However, when the work device is connected to the self-propelling vehicle body, the accumulator is attached to a relative high position of the loader work machine. Hence, due to this accumulator, the front visibility from a driver's seat is deteriorated. Moreover, the attachment of the accumulator to the connecting pipe deteriorates not only the front visibility, but the aesthetic appearance.

SUMMARY OF THE INVENTION

The object of the present invention is to provide a loader work machine which overcomes the above-described drawback.

For accomplishing the above-noted object, a loader work machine, according to the present invention, comprises:

a self-propelled machine body;

a work device having a boom, a boom cylinder, and a side frame for vertically pivotally supporting base portions of the boom and the boom cylinder;

a frame unit for attaching the work device to the self-propelled machine body, the frame unit including:

a support platform projecting laterally outward from the self-propelled machine body, and a main frame mounted erect on the support platform for supporting and connecting a lower portion of the side frame; and an accumulator connected to the boom cylinder for absorbing shock occurring during a vertical pivotal movement of the work device;

wherein said accumulator is attached to said frame unit.

With the above-described construction, the accumulator is attached to a lower position than the conventional construction. Hence, with elimination of blocking of the front view from the driver's seat toward the work device (e.g. a front loader), the front visibility can be improved and the aesthetic appearance of the work machine can be improved as well.

According to one preferred embodiment, said accumulator is stored within a lower portion of said frame unit. For instance, this accumulator can be stored inside the support platform which is formed like a cylinder.

According to one preferred embodiment, said main frame includes a selector valve operable to switch over the accumulator between a use condition and a non-use condition, with the selector valve being operable from a driver's seat mounted on the self-propelled machine body. With this construction, it is possible to shorten a hydraulic piping between the accumulator and the selector valve. Further, the switchover operation of the selector valve becomes more convenient.

According to one preferred embodiment, said support platform is formed like a cylindrical platform structure which accommodates therein a selector valve operable to switch over the accumulator between a use condition and a non-use condition. With this construction, not only the accumulator, but also the selector valve is accommodated within the support platform. Therefore, the blocking of the front view for the driver can be further prevented and the aesthetic appearance of the machine can be further improved.

Further and other features and advantages of the invention will become apparent upon reading the following detailed description of the preferred embodiments thereof with reference to the accompanying drawings.

DESCRIPTION OF THE PREFERRED EMBODIMENTS

Next, with reference to the accompanying drawings, respective preferred embodiments of the present invention will be described in details based on a tractor mount type loader as an example of a loader work machine relating to the present invention.

First Embodiment

Figure 1:
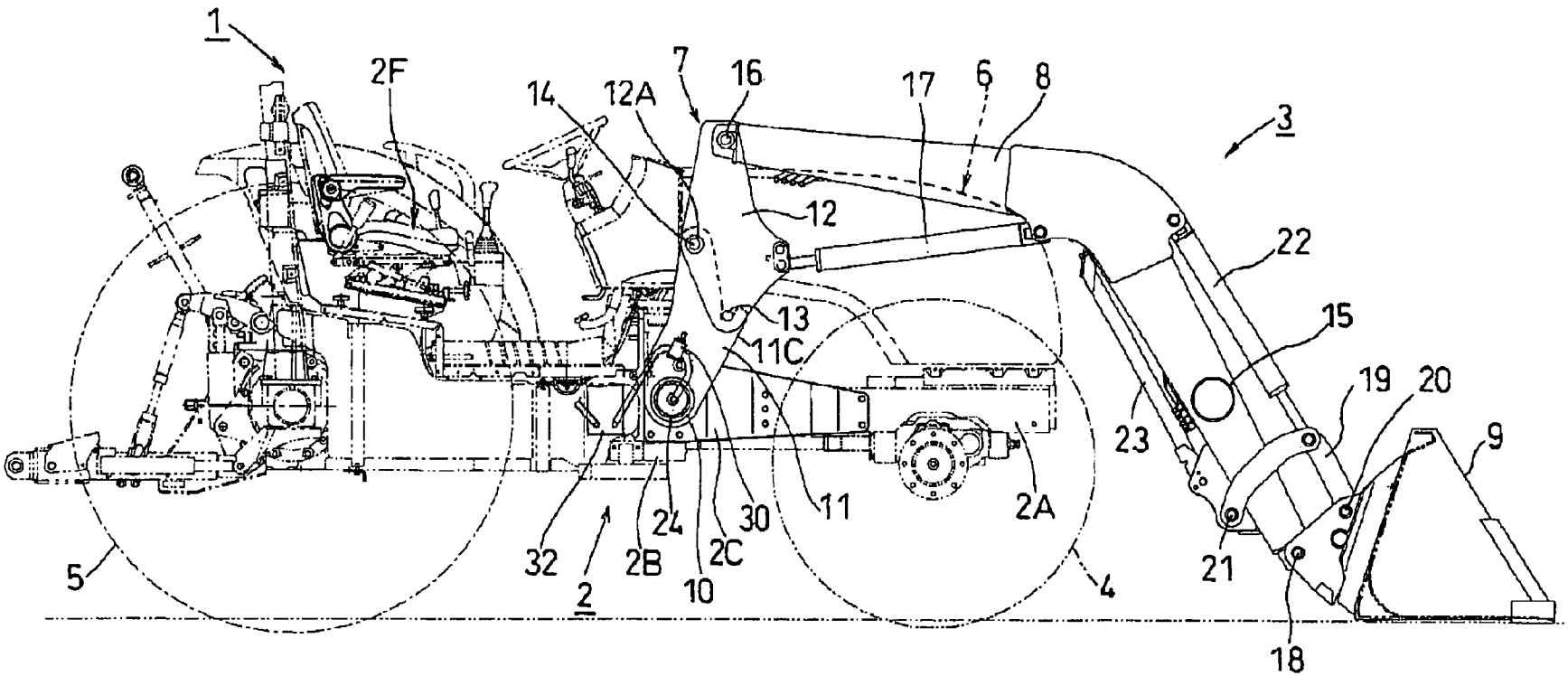
FIG. 1 is an overall side view of a tractor mount type loader implementing the present invention.

In FIG. 1, there is shown at 1 a tractor mount type loader comprising a tractor (loading/unloading vehicle) 2 as a self-propelled machine body and a front loader 3 as a work device attached to a front portion of the tractor 2.

The tractor 2 includes a pair of right and left front wheels 4, a pair of right and left rear wheels 5, and a hood 6 mounted at a front portion of the tractor for covering an engine, a radiator, etc.

The front loader 3 includes, as principal components thereof, attaching frames 7, boom members 8 and an implement 9 such as a bucket. The attaching frame 7 includes a cylindrical support platform 10, a main frame 11, and a side frame 12. And, the pairs of these components are disposed on the right and left sides of the tractor 2, respectively.

As shown in FIGS. 1-4, the tractor 2 includes a front axle frame 2A, a flywheel housing 2B and a connecting frame 2C interconnecting the frames 2A, 2B along the fore and aft direction.

The connecting frame 2C comprises a pair of plate-like members having front half portions thereof fastened to the right and left side faces of the front axle flame 2A by a plurality of bolts and having rear half portions thereof fastened to the right and left side faces of the flywheel housing 2B by a plurality of bolts. To the front portion of the flywheel housing 2B, the engine (not shown) is connected and to the rear portion thereof, a clutch housing, a transmission case and a rear wheel differential device are connected in the mentioned order.

The cylindrical support platform 10 comprises a metal pipe member such as a cylindrical steel pipe. This support platform 10 has its right/left inner end inserted into a circular hole 2D formed at a rear portion of the connecting frame 2C and fixedly welded about this circular hole 2D. With this, right/left outer ends of the support platform 10 project outward in the right/left direction from the tractor 2. And, on the right and left outer ends of the support platform 10, the main frames 1 are attached to project upward therefrom. To this end, each main frame 11 forms, at a lower end thereof, a circular hole 11A, in which the right/left outer end of the support platform 10 is inserted and the support platform 10 is fixedly welded around this circular hole 11A.

Figure 2:
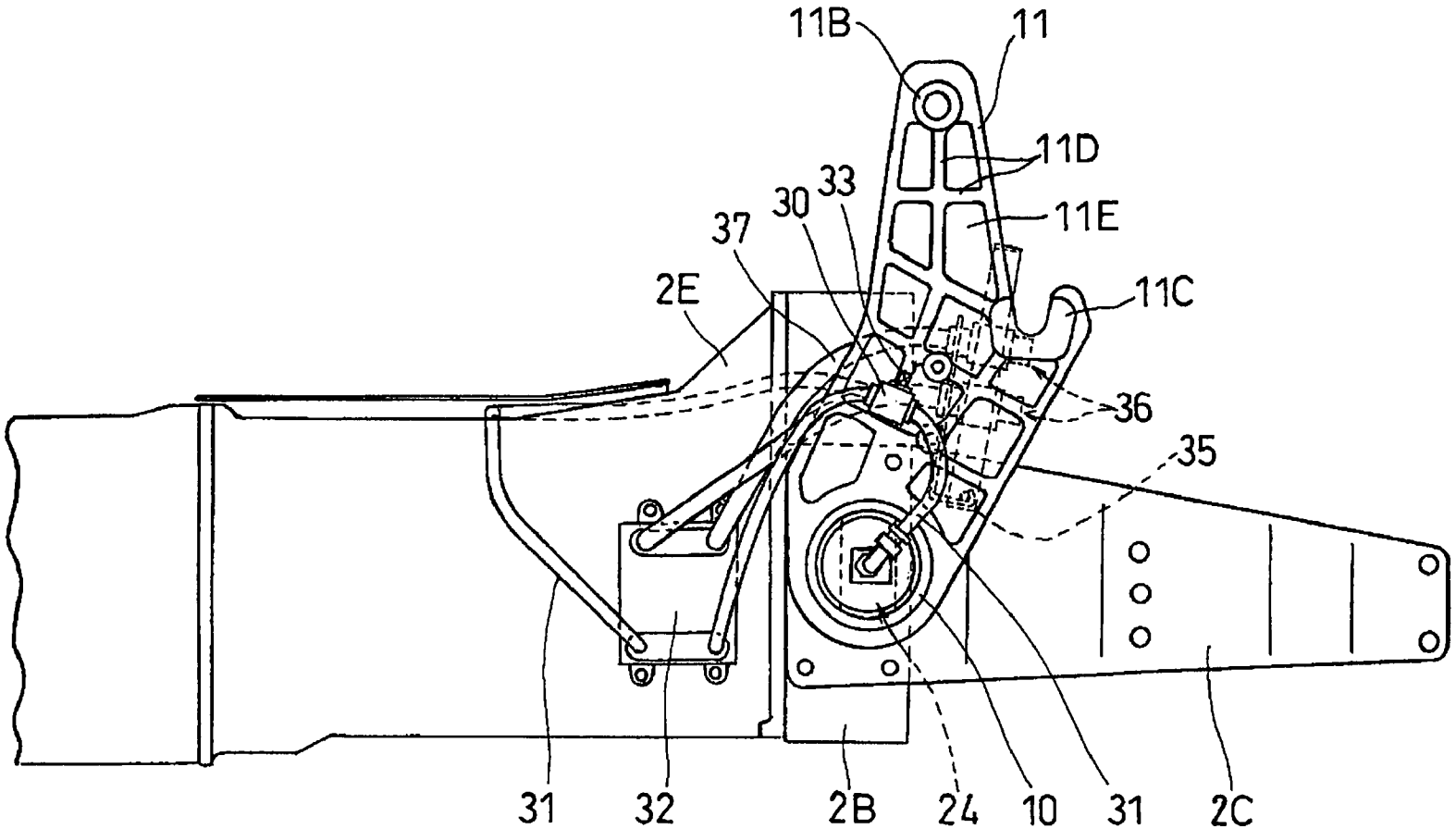
FIG. 2 is a partially enlarged side view of an accumulator attaching portion.

Referring more particular to the main frame 11, as shown in FIG. 2, at an upper portion thereof, there is integrally formed a cylindrical boss portion 11B forming a pin hole having a right/left axis and, at a front portion of a vertically intermediate portion thereof, there is integrally formed a receiving portion 11C having an upwardly open arcuate receiving recess. This main frame 11 is integrally formed as a single plate (thick plate) made of cast steel. In the opposed lateral plate face portions (or one lateral plate face portion), there are formed a plurality of reinforcing ribs 11D arranged to intersect with each other in the vertical and fore-and-aft directions, with forming recesses 11E between adjacent reinforcing ribs 11D for achieving weight reduction.

The main frames 11 described above are attached to the front opposed lateral faces of the tractor 2 via the support platforms 10 and the connecting frames 2C so as to detachably connect the side frames 12 of the front loader 3 to the front portion of the tractor 2.

The side frames 12 are attached to rear ends of the pair of right and left boom members 8 of the front loader 3 so as to detachably connect the front loader 3 to the front portion of the tractor 2 with using the main frames 11.

To the above end, to the lower end of each side frame 12, there is integrally fixed an engaging pin 13 engageable with the receiving portion 11C of the main frame 11. Further, at a rear portion of a vertically intermediate portion of the side frame 12, there is integrally provided a cylindrical boss portion 12A having a pin hole corresponding to the boss portion 11B of the main frame 11.

Then, with engaging the receiving portions 11C of the main frames 11 to the engaging pins 13 of the side frames 12, the opposed boss portions 11B, 12A will be placed in registry with each other and the connecting pins 14 will be inserted therethrough, whereby the front loader 3 can be connected to the tractor 2. Further, by removing the connecting pins 14, the front loader 3 becomes detachable from the tractor 2.

The boom member 8, as shown in FIG. 1, is bent at a longitudinally intermediate portion thereof, so that this entire member 3 presents a mountain-like shape convexed upward. Further, the boom member 8 has a progressively larger height from the fore and rear end portions thereof toward the longitudinally center portion thereof. And, this entire boom member 8 is formed like a substantially angular tubular structure made of a metal plate member such as a steel plate. And, the pair of the boom members 8 are provided on the right and left sides of the hood 6. The front portions of the right and left boom members 8 are interconnected via a connecting pipe 15.

Each of the right and left boom members 8 is pivotally connected, at a proximal end (rear end) end thereof, via a pin 16 to the upper portion of the corresponding side frame 12 to be vertically pivotal about a right/left axis.

Further, from the longitudinal intermediate portion of each right/left boom member 8 to a vertically intermediate portion of each right/left side frame 12, there is disposed a boom cylinder 17 comprised of a double acting type hydraulic cylinder. In operation, in association with extension/contraction of these right and left boom cylinders 17, the right and left boom members 8 can be vertically pivoted.

To a rear side lower portion of the implement 9, leading ends (front ends) of the respective boom members 8 are pivotally connected via pins 18. And, between the rear face of the implement 9 and the vicinity of the leading end of each right/left boom member 8, opposed ends of a two-foldable extension/contraction link 19 are connected via pins 20, 21. Further, between an upper face of the longitudinally intermediate portion of each right/left boom member 8 and a mid connecting point of the two-foldable extension/contraction link 19, there is disposed a bucket cylinder 22 comprised of a double acting type hydraulic cylinder. Then, in association with extension/contraction of the bucket cylinders 22, the implement 9 can be pivoted (for a rollback or dumping operation).

Along the lower face on the leading end side of the boom member 8, a stand 23 is attached. This stand 23 is used for supporting the boom member 8 to allow this member 8 to stand alone with the implement 9 being placed on the ground surface, when the front loader 3 is to be detached from the tractor 2. Incidentally, this stand 23 can be stored and held along the lower face of the leading end side of the boom member 8.

To the hydraulic circuit of the boom cylinder 17, there is connected an accumulator 24. This accumulator 24 is disposed on the side of the main frame 11. In the present embodiment, there is disclosed an exemplary construction wherein the accumulator 24 is stored within the support platform 10 of the main frame 11. As the support platforms 10 are provided on the right and left sides of the tractor 2, the accumulators 24 are accommodated similarly within the right and left support platforms 10. In the present embodiment, one accumulator 24 is connected respectively to a boom elevating side oil passage and a boom lowering side oil passage of the hydraulic circuitry (not shown) of the boom cylinder 17.

Figure 5:
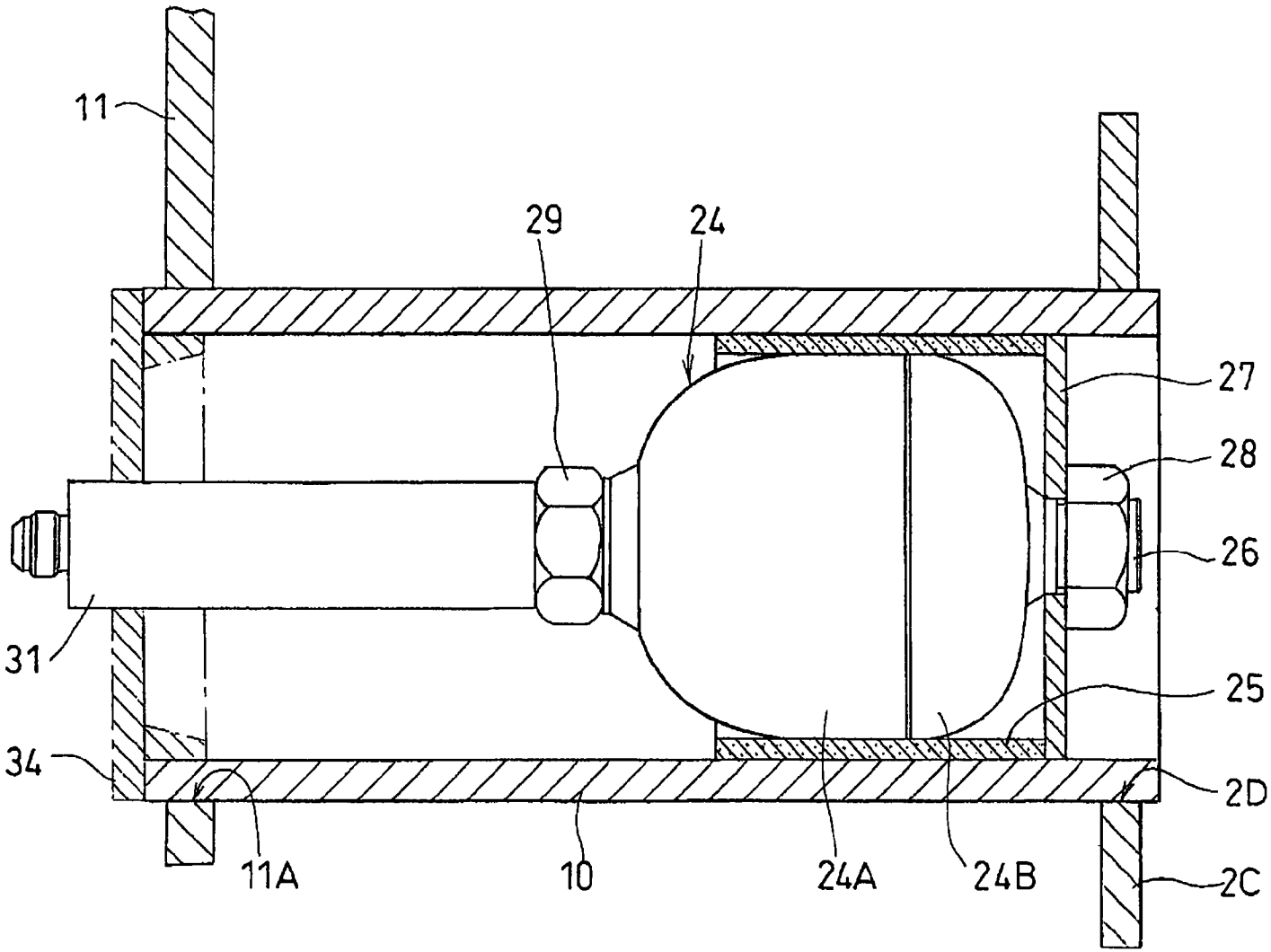
FIG. 5 is an enlarged section of a support platform portion accommodating an accumulator therein.

The accumulator 24, as shown in FIG. 5, consists essentially of a cylindrical body 24A having a slightly smaller outer diameter than the inner diameter of the cylindrical support platform 10 and a lid member 24B air-tightly fastened to the body 24A. And, this accumulator 24 is accommodated within the support platform 10 via a cushion member 25 such as a rubber sheet, and an attaching bolt 26 provided at an end of the body 24A is inserted through an attaching plate 27 affixed to right/left inner side of the cylindrical platform 10 and fastened thereto by a nut 28.

Figure 3:
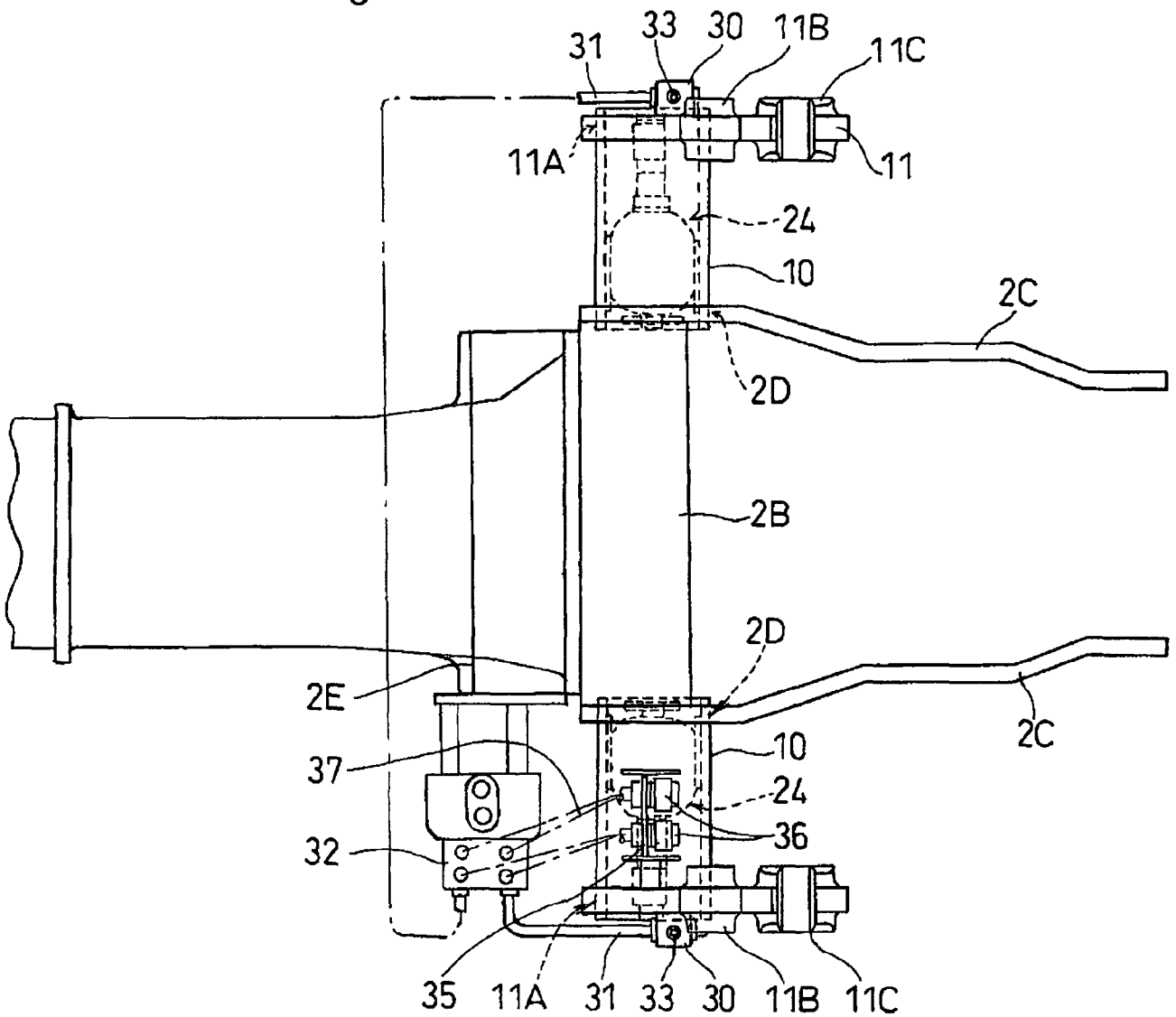
FIG. 3 is a plan view of FIG. 2.
Figure 4:
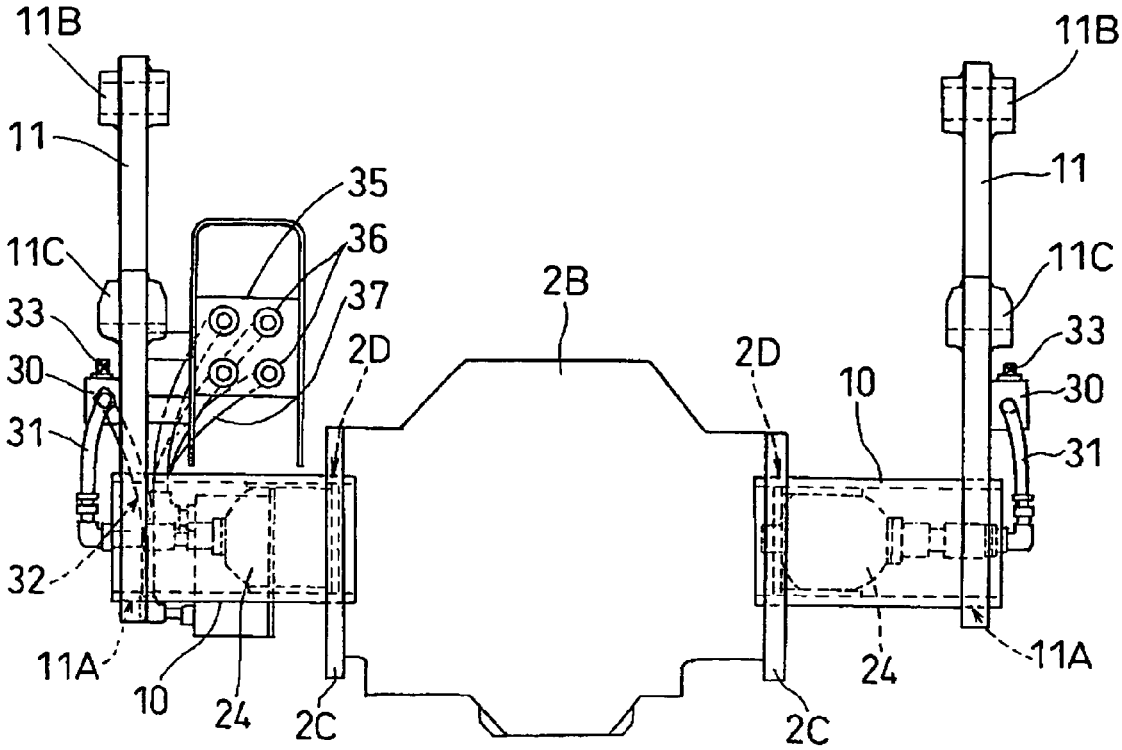
FIG. 4 is a front view of FIG. 2.

As shown also in FIG. 5, each accumulator 24 accommodated within the right/left support platform 10 includes a pipe connecting member 29 at an end on the right/left outer side of the cylindrical support platform 10, and to this pipe connecting member 29, a hydraulic pipe 31 is connected. This hydraulic pipe 31 is drawn out through an open end on the right/left outer side of the support platform 10, and then connected to a selector valve 30 attached to a side face of the main frame 11, which side face is exemplified as a position operable for switchover operation from a driver's set 2F of the tractor 2. The selector valve 30 is connected via the hydraulic pipe 31 to a predetermined connecting port of a control valve 32. This control valve 32, as shown in FIGS. 2-4, is attached to the right side face of the clutch housing 2E constituting a part of the vehicle body of the tractor 2. To the selector valve 32, there is pivotally attached a handle shaft 33. Then, as this handle shaft 33 is pivoted with a convenient tool (not shown) such as a spanner, the selector valve 30 switches over the oil passage to an open condition or to a closed condition. With this, the accumulator 24 is switched over between a use condition and a non-use condition. The above-described operational tool can be permanently attached to the handle shaft 33 or detachably attached thereto.

In the foregoing embodiment, the selector valve 30 is provided at the side face of the main frame 11 as an example of a position switchably operable from the driver's seat 2F of the tractor 2. Instead, the valve 30 can be provided at any other position, e.g. to the rear face of the main frame 11 or can be attached directly or indirectly via an appropriate attaching bracket to a portion of the vehicle body of the tractor 2. In short, this selector valve 30 should be connected to a mid portion of the hydraulic pipe 31 connecting the accumulator 24 and the control valve 32, and be disposed at a position conveniently operable for switchover from the driver's seat 2F of the tractor 2.

Figure 6:
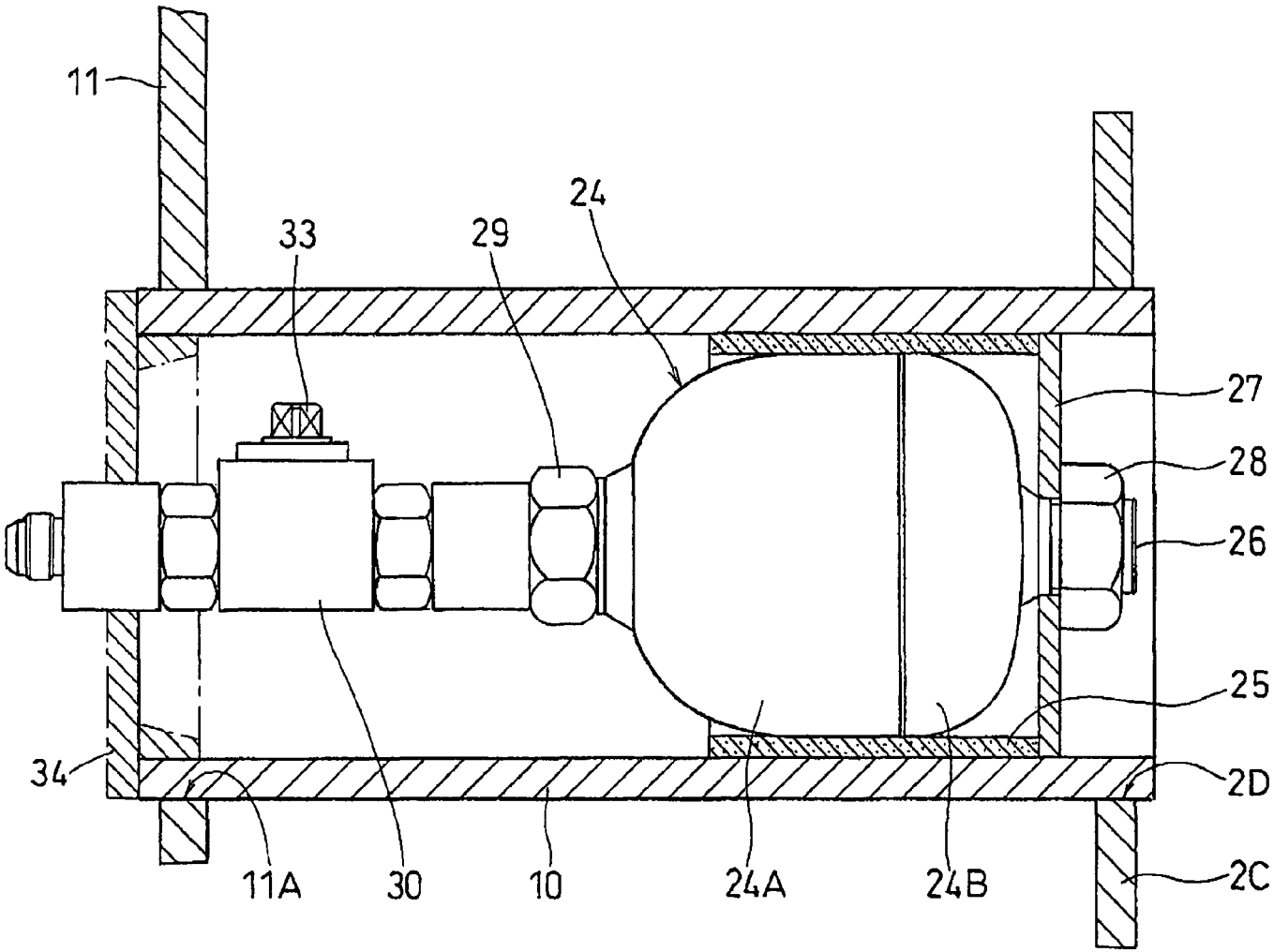
FIG. 6 is an enlarged section of a support platform relating to a further embodiment of the invention which accommodates a selector valve in addition to the accumulator.

Incidentally, the selector valve 30 may be disposed adjacent the accumulator 24. For instance, as shown in FIG. 6, the selector valve 30 may be accommodated within the support platform 10 together with the accumulator 24. In this case, the pivoting operation of the handle shaft 33 is to be effected by inserting the tool from the open end on the right/left outer side of the support platform 10. Incidentally, at this open end on the right/left outer side of the support platform 10, there is detachably attached a lid member 34 made of rubber or plastics for preventing intrusion of dust or the like. This lid member 34 will be detached when the pivoting operation of the handle shaft 33 is to be effected.

To the inner face of the main frame 11 disposed on the right side of the tractor 2, there is attached, via a support bracket 35, a hydraulic pipe connecting terminal tool 36. This hydraulic pipe connecting terminal tool 36 is connected via a hydraulic pipe 37 to the control valve 32. The control valve 32 is connected to a hydraulic pump and an oil tank (not shown) mounted on the tractor 2. The hydraulic pipe connecting terminal tool 36 is used for feeding/discharging working oil to/from the boom cylinders 17 and the bucket cylinders 22 of the front loader 3. The hydraulic pipe (not shown) to the boom cylinders 17 and the hydraulic pipe (not shown) to the bucket cylinders 22 are arranged along the boom members 8 of the front loader 3. And, to terminal ends of these hydraulic pipes too, there are provided hydraulic pipe connecting terminal tools (not shown) which are connectable to and detachable from the terminal tool 36 in the male-female arrangement. These terminal tools will be connected or detached when the front load 3 is mounted to or dismounted from the tractor 2.

Next, the operations of this embodiment having the above-described construction will be described.

As shown in FIG. 1, when a work is to be effected by the front loader 3 with this loader 3 being mounted to the tractor 2, by selective operations of the selector valves 30, there are three types of operations selectable, i.e. one rendering both of the right and left accumulators 24 usable, another rendering both unusable and still another rendering one of them usable, rendering the other unusable.

First, the case of rendering both of the right and left accumulators 24 usable is a case where, during a work with vertically pivoting the boom members 8 by the boom cylinders 17, sudden change in the loads due to some cause is expected or it is necessary to avoid generation of such shock per se. In such case, the work will be carried out with opening the right and left selector valves 30. With this, even if there occurs sudden surge in the oil pressure in the hydraulic pipes connected to the boom cylinders 17, this can be absorbed and relieved by the accumulators 24, thus effectively preventing transmission of significant shock to the driver and to the implement 9 such as the bucket. As a result, it is possible to avoid fall of the load as well as damage to the boom members 8 and the implement 9. Moreover, it is possible to avoid burst of the hydraulic pipes or oil leaks therefrom.

The case of rendering both the right and left accumulators 24 unusable is a case where the boom cylinders 17 need to be operated with maximum hydraulic forces. In such case, the work will be effected with closing the right and left selector valves 30.

Further, in the case of effecting work with rendering only the elevating operation side accumulator 24 for the boom cylinder 17 usable and rendering the lowering operation side accumulator 24 unusable or in the converse case, the work will be effected with the corresponding one of the right and left selector valves 30 open and the other closed.

According to the present invention described above, as the accumulator 24 is accommodated within the support platform 10, during a work of the front loader 3, the accumulator 24 does not impair the front view of the driver and the aesthetic appearance is improved also. Further, there is no increase in the weight of the boom members 8. Incidentally, the accumulator 24 need not be accommodated within the support platform 10, but may be provided on the side of the main frame 11 outside the support platform 10, and in such case too, no deterioration in the driver's front view will occur and no weight increase in the boom member 8 will occur, either.

Second Embodiment

FIG. 6 shows a loader work machine according to a second embodiment of the present invention.

In this embodiment, the selector valve 30 is accommodated within the support platform 10. With this accommodation within the support platform 10, piping layout can be facilitated and the appearance can be improved.

The rest of the construction is identical to the first embodiment.

Other Embodiments

The present invention is not limited to the foregoing embodiments.

For instance, both of the right and left accumulators 24 can be used only for either elevating or lowering operation of the boom cylinders 17. Or, instead of providing the accumulators on the opposed right and left sides, one integral accumulator may be provided to be used for only either elevating or lowering side of the boom cylinders 17. In this case, the accumulator 24 may be accommodated within only one of the right and left support platforms 10 or may be disposed outside the support platform 10 to be attached to a portion of the main frame 11 or a portion of the vehicle body of the tractor 2.

Further, the disposing position of the selector valve 30 is not limited to the one described in the foregoing embodiment. The selector valve 30 may be disposed outside the support platform 10 at any appropriate position operable for switchover from the driver's seat 2F. For instance, this selector valve 30 may be attached to a portion of the main frame 11, so that the driver as being seated at the driver's seat 2F can operate the valve without having to get off the vehicle body.

Incidentally, in the above case of disposing the selector valve 30 outside the support platform 10 to be attached to a portion of the main frame 11 or of the vehicle body, the two selector valves may both be disposed on one either side. This arrangement allows operation of the two selector valves on one side, thus further improving the operability.

The invention claimed is:

1. A loader work machine comprising:

a self-propelled machine body comprising:

a front axle frame;

a flywheel housing provided rearwardly of the front axle frame;

a clutch housing provided rearwardly of the flywheel housing; and a connecting frame interconnecting the front axle frame and the flywheel housing;

a work device having a boom, a boom cylinder, and a side frame for vertically pivotally supporting base portions of the boom and the boom cylinder;

a frame unit for attaching the work device to the self-propelled machine body, the frame unit comprising:

a support platform projecting laterally outward from a rear portion of the connecting frame at a lower portion of said frame unit, and a main frame mounted erect on the support platform for supporting and connecting a lower portion of the side frame to the support platform; and an accumulator connected to the boom cylinder for absorbing shock occurring during a vertical pivotal movement of the work device;

wherein said support platform is a cylindrical platform structure in which said accumulator is stored; and wherein the accumulator is connected to a hydraulic control valve to fluidly couple the accumulator to hydraulic circuitry of the loader work machine, with the control valve mounted to the clutch housing to extend laterally outward from the clutch housing and enable fluid connection with the accumulator.

2. The loader work machine according to claim 1, wherein said main frame includes a selector valve operable to switch over the accumulator between a use condition and a non-use condition, with the selector valve being operable from a driver's seat mounted on the self-propelled machine body.

3. The loader work machine according to claim 1, wherein said support platform accommodates therein a selector valve operable to switch over the accumulator between a use condition and a non-use condition.

4. The loader work machine according to claim 1, wherein said connecting frame has a circular hole formed at a rear portion thereof, and wherein said support platform is a cylindrical platform structure to be received into said circular hole and fixedly welded about said circular hole.

5. A loader work machine comprising:

a self-propelled machine body;

a work device having a boom, a boom cylinder, and a side frame for vertically pivotally supporting base portions of the boom and the boom cylinder;

a frame unit for attaching the work device to the self-propelled machine body, the frame unit comprising:

a support platform projecting laterally outward from a rear portion of a connecting frame at a lower portion of said frame unit, and a main frame mounted erect on the support platform with a space from the connecting frame for supporting and connecting a lower portion of the side frame to the support platform;

an accumulator connected to the boom cylinder for absorbing shock occurring during a vertical pivotal movement of the work device; and a selector valve operable to switch over the accumulator between a use condition and a non-use condition, the selector valve being operable from a driver's seat mounted on the self-propelled machine body;

wherein said support platform is a cylindrical platform structure having an open end to store said accumulator therein between the main frame and the connecting frame, a hydraulic pipe connecting said accumulator to said selector valve being drawn out through said open end.

6. A loader work machine comprising:

a self-propelled machine body;

a work device having a boom, a boom cylinder, and a side frame for vertically pivotally supporting base portions of the boom and the boom cylinder;

a frame unit for attaching the work device to the self-propelled machine body, the frame unit comprising:

a support platform projecting laterally outward from a rear portion of a connecting frame at a lower portion of said frame unit, and a main frame mounted erect on the support platform with a space from the connecting frame for supporting and connecting a lower portion of the side frame to the support platform;

an accumulator connected to the boom cylinder for absorbing shock occurring during a vertical pivotal movement of the work device; and a selector valve operable to switch over the accumulator between a use condition and a non-use condition, said support platform accommodating therein said accumulator and said selector valve laterally outward of the accumulator;

wherein said support platform is a cylindrical platform structure having an open end to store said accumulator therein between the main frame and the connecting frame, a hydraulic pipe extending from said selector valve being drawn out through said open end.

* * * * *